US008925682B2

(12) United States Patent
Chitayat et al.

(10) Patent No.: US 8,925,682 B2
(45) Date of Patent: Jan. 6, 2015

(54) CONVERTIBLE STEP STOOL

(75) Inventors: David Dennys Chitayat, Shanghai (CN); Pieter Schouten, Berkeley, CA (US)

(73) Assignee: Genimex Jersey Ltd., Shanghai (CN)

( * ) Notice: Subject to any disclaimer, the term of this patent is extended or adjusted under 35 U.S.C. 154(b) by 0 days.

(21) Appl. No.: 13/363,020

(22) Filed: Jan. 31, 2012

(65) Prior Publication Data

US 2013/0192925 A1 Aug. 1, 2013

(51) Int. Cl.
*A47C 12/00* (2006.01)
*A47C 13/00* (2006.01)

(52) U.S. Cl.
USPC ..... 182/33; 182/223; 182/152; 297/119; 428/52; 248/127

(58) Field of Classification Search
USPC ..... 182/33, 223, 28, 20, 21, 222, 130–132, 182/152; 482/142, 35, 36, 52; 108/39, 40, 108/94, 95, 166, 68, 17, 167, 11–13; 297/119, 423.13; 248/127, 371, 424, 248/166, 176.3
See application file for complete search history.

(56) References Cited

U.S. PATENT DOCUMENTS 139,488 A * 6/1873 Willgohs ..... 182/33.2
190,027 A * 4/1877 Goffette ..... 182/33.2
212,778 A * 2/1879 Woolverton ..... 297/110
395,539 A * 1/1889 Bockenheuser ..... 182/33.2
1,280,797 A * 10/1918 Michenfelder ..... 182/33.6
1,421,929 A * 7/1922 Floreskul ..... 297/377
2,097,273 A * 10/1937 Feist ..... 482/52
2,512,827 A * 6/1950 Collin ..... 182/33.2
2,592,912 A * 4/1952 Knipper ..... 182/33
2,666,210 A * 1/1954 Wiley ..... 4/478
2,829,939 A * 4/1958 Hoppe ..... 312/241
3,035,671 A * 5/1962 Sicherman ..... 52/183
3,346,317 A * 10/1967 Peggs ..... 312/258
3,564,790 A * 2/1971 Rehfeld ..... 52/183
4,478,413 A * 10/1984 Siwula ..... 482/127
4,753,320 A * 6/1988 Walter ..... 182/33
4,844,199 A * 7/1989 Nimz ..... 182/106
5,094,505 A * 3/1992 Nichols ..... 297/118
5,341,897 A * 8/1994 Gross ..... 182/88
5,343,817 A * 9/1994 Abraham et al. ..... 108/97
5,357,876 A * 10/1994 Kniefel et al. ..... 108/92
5,474,509 A * 12/1995 Hodgdon ..... 482/52
5,647,632 A * 7/1997 Fireman ..... 297/109
5,715,910 A * 2/1998 Koch et al. ..... 182/200

(Continued)

OTHER PUBLICATIONS

Definition of "edge" provided in Action The American Heritage Dictionary of the English Language, Fourth Edition copyright © 2000 by Houghton Mifflin Company. Updated in 2009. Published by Houghton Mifflin Company. All rights reserved.*

(Continued)

*Primary Examiner* — Daniel Cahn
(74) *Attorney, Agent, or Firm* — Patent Law Offices of Michael E. Woods; Michael E. Woods

(57) ABSTRACT

An apparatus and method for a children's convertible dual mode step stool that includes both a single-step mode and a double-step mode. A moveable housing, coupled to a base housing, selectively and lockably maintains either of two different ninety degree orientations to present a desired one of either a single-step mode or a double-step mode.

10 Claims, 3 Drawing Sheets

(56) References Cited

U.S. PATENT DOCUMENTS

| | | | | |
|---|---|---|---|---|
| 6,089,661 | A * | 7/2000 | Åstrom | 297/237 |
| D429,038 | S * | 8/2000 | Forester | D30/119 |
| 6,113,182 | A * | 9/2000 | Wise | 297/119 |
| D460,566 | S * | 7/2002 | Henschel et al. | D25/65 |
| 6,439,342 | B1 * | 8/2002 | Boykin | 182/88 |
| 6,543,070 | B2 * | 4/2003 | Longenecker et al. | 5/93.1 |
| 6,571,915 | B1 * | 6/2003 | de la Tour | 182/152 |
| 6,634,998 | B2 * | 10/2003 | Siaperas | 482/142 |
| 6,926,119 | B1 * | 8/2005 | Schrock | 182/33 |
| 7,017,708 | B1 * | 3/2006 | Lynn | 182/35 |
| 7,261,377 | B2 * | 8/2007 | Ehud | 297/283.1 |
| 7,278,515 | B2 * | 10/2007 | Moser et al. | 182/152 |
| 7,651,452 | B2 * | 1/2010 | Weir et al. | 482/142 |
| 8,141,680 | B2 * | 3/2012 | Wigutoff | 182/33 |
| 8,152,233 | B2 * | 4/2012 | Wechter | 297/124 |
| 8,453,795 | B2 * | 6/2013 | Lee et al. | 182/33 |
| 8,657,069 | B1 * | 2/2014 | Schwengels | 182/33 |
| 8,701,830 | B2 * | 4/2014 | Merey | 182/152 |
| 2005/0029049 | A1 * | 2/2005 | Moser et al. | 182/152 |
| 2007/0273181 | A1 * | 11/2007 | Wechter | 297/119 |
| 2008/0251319 | A1 * | 10/2008 | Meyers et al. | 182/161 |
| 2008/0257280 | A1 * | 10/2008 | Jakubowski et al. | 119/849 |
| 2010/0187041 | A1 * | 7/2010 | Crouch | 182/223 |
| 2011/0017547 | A1 * | 1/2011 | Lee et al. | 182/23 |
| 2011/0114419 | A1 * | 5/2011 | Merey | 182/152 |
| 2011/0247898 | A1 * | 10/2011 | Wigutoff | 182/223 |
| 2012/0004083 | A1 * | 1/2012 | Cuba | 482/142 |
| 2013/0048428 | A1 * | 2/2013 | Chancler | 182/155 |
| 2013/0186709 | A1 * | 7/2013 | White | 182/89 |

OTHER PUBLICATIONS

Definition of "generally" provided in Action The American Heritage Dictionary of the English Language, Fourth Edition copyright © 2000 by Houghton Mifflin Company. Updated in 2009. Published by Houghton Mifflin Company. All rights reserved.*

Definition of "coplanar" provided in Action The American Heritage Dictionary of the English Language, Fourth Edition copyright © 2000 by Houghton Mifflin Company. Updated in 2009. Published by Houghton Mifflin Company. All rights reserved.*

* cited by examiner

CONVERTIBLE STEP STOOL

BACKGROUND OF THE INVENTION

The invention relates generally to step stools, and more particularly but not exclusively to convertible step stools for children that have a dual mode: both a single-step mode and a double-step mode.

Children as they grow and gain balance and equilibrium increasingly have need to reach objects higher than they can reach unassisted. A step stool especially designed for children, based about tread width and height, is a solution.

As is true for many products designed for children, a child can quickly outgrow any single piece of equipment. Thus it is common to combine different pieces of equipment to save on space and other costs.

It is also the case that a single height step stool is not always convenient to enable the child to reach desired objects. As a child gains further balance and coordination skills, it would be advantageous to replace a single-step step stool with a double-step step stool. It is not practical to have both types of step stools, nor to replace one with another, particularly when there are children of different ages and skill levels present.

What is needed is a children's convertible step stool that includes both a single-step mode and a double-step mode.

BRIEF SUMMARY OF THE INVENTION

Disclosed is an apparatus and method for a children's convertible dual mode step stool that includes both a single-step mode and a double-step mode.

Features/benefits include efficient space saving features enabling a child to reach to different heights, particularly as the child's balance and coordination permit stepping and climbing upon a second step, without requiring two step stools, or a single step stool having two steps.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a device and method for a children's convertible step stool that includes both a single-step mode and a double-step mode. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 2:
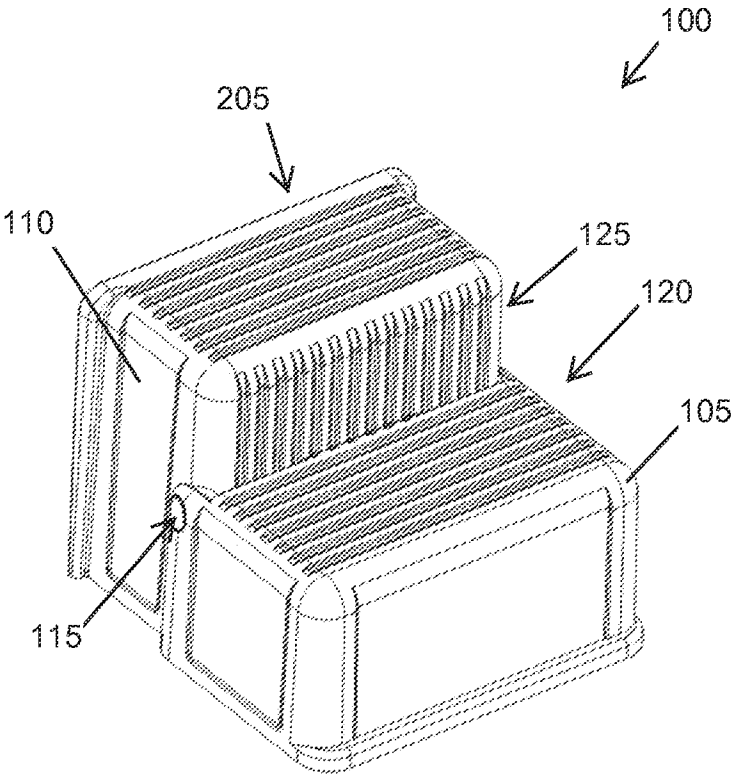
FIG. 2 illustrates a perspective view of the convertible dual mode step stool of FIG. 1 in a double-step mode.
Figure 1:
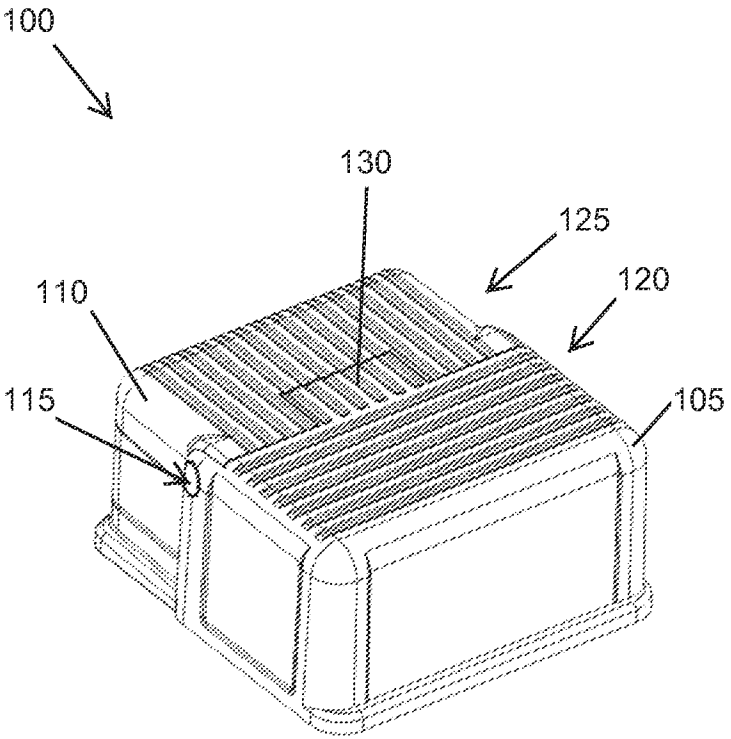
FIG. 1 illustrates a perspective view of a convertible dual mode step stool in a single-step mode.
Figure 3:
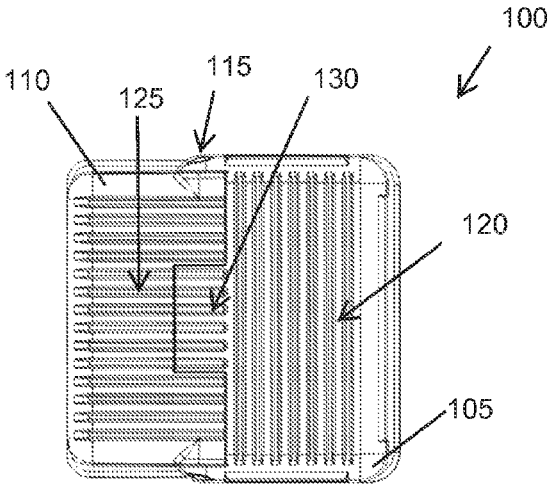
FIG. 3 illustrates a top view of the convertible dual mode step stool of FIG. 1.
Figure 4:
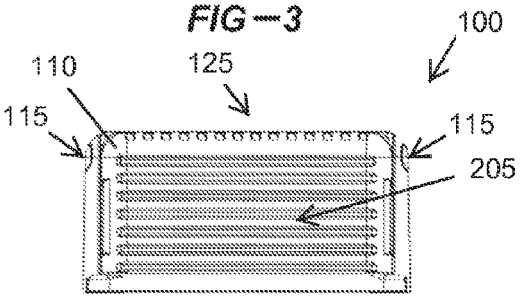
FIG. 4 illustrates a back view of the convertible dual mode step stool of FIG. 1.
Figure 5:
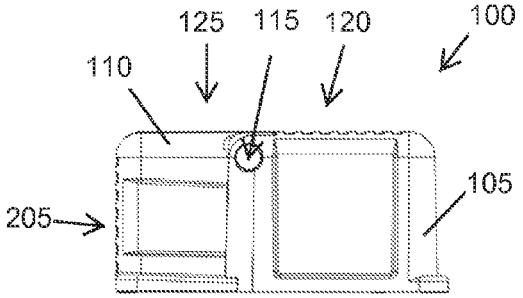
FIG. 5 illustrates a left-hand view of the convertible dual mode step stool of FIG. 1.
Figure 6:
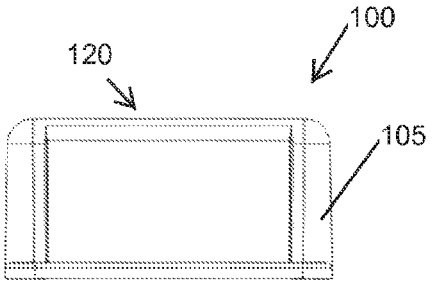
FIG. 6 illustrates a front view of the convertible dual mode step stool of FIG. 1.
Figure 7:
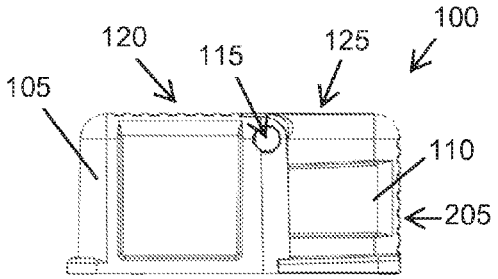
FIG. 7 illustrates a right-hand view of the convertible dual mode step stool of FIG. 1.
Figure 8:
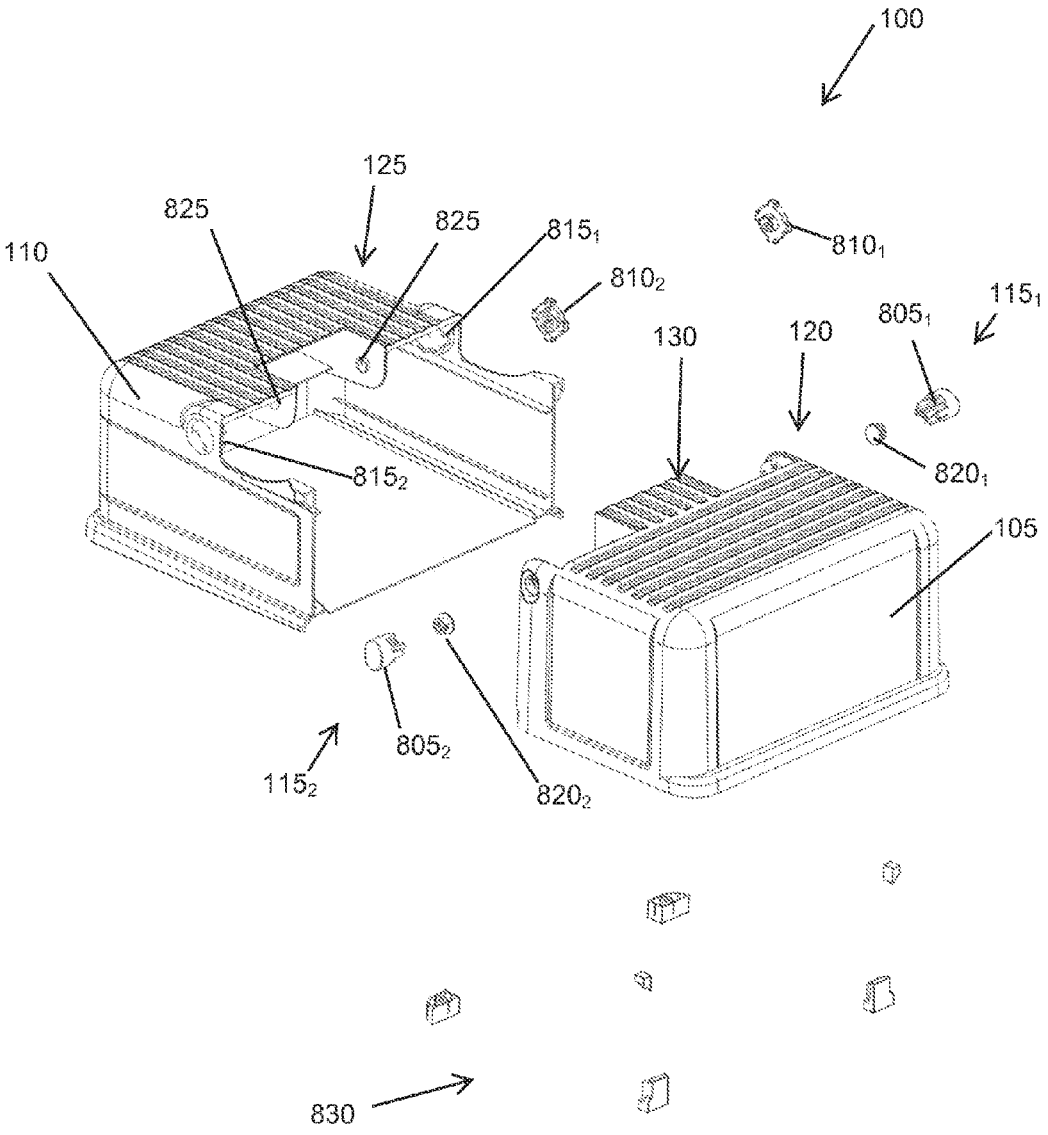
FIG. 8 illustrates an exploded view of the convertible dual mode step stool of FIG. 1.

FIG. 1 illustrates a perspective view of a convertible dual mode step stool 100 in a single-step mode. FIG. 2 illustrates a perspective view of convertible dual mode step stool 100 of FIG. 1 in a double-step mode. FIG. 3 illustrates a top view of convertible dual mode step stool 100 of FIG. 1. FIG. 4 illustrates a back view of convertible dual mode step stool 100 of FIG. 1. FIG. 5 illustrates a left-hand view of the convertible dual mode step stool 100 of FIG. 1. FIG. 6 illustrates a front view of convertible dual mode step stool 100 of FIG. 1. FIG. 7 illustrates a right-hand view of convertible dual mode step stool 100 of FIG. 1. FIG. 8 illustrates an exploded view of convertible dual mode step stool 100 of FIG. 1.

Convertible dual mode step stool 100 includes a base housing 105 moveably (e.g., rotationally) coupled to a moveable housing 110. Moveable housing 110 preferably rotates relative to base housing 105 to selectively convert between the single-step mode and the double-step mode. A spring-loaded lock 115 maintains convertible dual mode step stool 100 in the selected mode and must be actuated in order to transition convertible dual mode step stool 100 between modes. A non-slip surface is applied to a top surface 120 of base housing 105 and to a top surface 125 of moveable housing 110. A flange extension 130 on top surface 120 extends into a complementary slot receptacle on top surface 125 which supports an additional pair of pivot points to aid in the relative motion of moveable housing 110 with respect to base housing 105 as further described herein. Additionally flange extension 130 aids as a rotational stop when rotating moveable housing 110 relative to base housing 105 to stop at about 90° rotation. A lateral face 205 of moveable housing 110 also includes the non-slip surface as it becomes a topmost tread when moveable housing 110 is rotated from the orientation shown in FIG. 1 and locked into the orientation shown in FIG. 2.

Further details of the locking system and rotation points are shown in FIG. 8. Base housing 105 and moveable housing 110 are preferably molded of plastic. Spring-loaded lock 115 includes a pushbutton 805 that is coupled to and interacts with a locking plate 810 mounted in a locking receptacle 815 molded into an inside surface of moveable housing 110. A retainer 820 maintains the desired assembly of spring-loaded lock 115 when coupling base housing 105 to moveable housing 110.

A pair of molded in axial projections 825 on an inside vertical surface of the complementary slot receptacle on top surface 125 rotationally mate to a corresponding pair of apertures (not shown) on an outside vertical surface of flange extension 130 in axial alignment with spring-loaded lock 115. This supports rotation of moveable housing 110 without a pin or rod extending therethrough and enables the locking solution shown. A collection of non-skid feet 830 are coupled to the underside of base housing 105 and moveable housing 110 (which has two underside modes—the un-rotated and rotated configurations which both present surfaces for interfacing to the floor or other support platform upon which convertible dual mode step stool 100 rests which accounts for the six non-skid feet 830 shown).

In operation, when transitioning convertible dual mode step stool 100 from the single-step mode (FIG. 1) to the double-step mode (FIG. 2), spring-loaded lock 115 is depressed and lateral face 205 of moveable housing 110 is moved to face upwards (moveable housing 110 rotates about 90° during this procedure). Spring-loaded lock 115 snaps into place when at the proper orientation and maintains moveable housing 110 in the rotated orientation (and thus maintains convertible dual mode step stool 100 in the double-step mode) as long as the double-step mode is desired. When the single-step mode is desired, spring-loaded lock 115 is depressed and lateral face 205 of moveable housing 110 is moved to face horizontally (moveable housing 110 rotates about 90° in the opposite direction during this procedure). Spring-loaded lock 115 snaps into place when at the proper orientation and maintains moveable housing 110 in the unrotated orientation (and thus maintains convertible dual mode step stool 100 in the single-step mode) as long as the single-step mode is desired.

The system and methods above has been described in general terms as an aid to understanding details of preferred embodiments of the present invention. In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A convertible step stool moveable between a single step mode and a double step mode, said convertible step stool comprising:

a base housing having a first planar top surface coupled to a first plurality of walls, said first plurality of walls including a rectilinear front wall and a first pair of opposing rectilinear side walls, each opposing rectilinear side wall of said first pair of opposing rectilinear side walls respectively having a base housing bottom edge, a rearward edge, a base housing top edge coupled to said first planar top surface, and a front edge, wherein said front wall is coupled approximately perpendicularly to said first planar top surface and extends between said front edges;

a moveable housing, rotatably coupled to said base housing, having a second planar top surface coupled to a second plurality of walls, said second plurality of walls including a rectilinear back wall and a second pair of opposing rectilinear side walls, each opposing rectilinear side wall of said second pair of rectilinear side walls respectively having a moveable housing bottom edge, a forward edge, a moveable housing top edge coupled to said second planar top surface, and a back edge, wherein said back wall is coupled approximately perpendicularly to said second planar top surface and extends between said back edges;

wherein said front wall has a first major length extending between said front edges;

wherein said back wall has a second major length extending between said back edges, said second major length being less than said first major length;

wherein each opposing rectilinear side wall of said first pair of opposing rectilinear side walls respectively has a first height extending from respective said base housing bottom edges to respective said base housing top edges;

wherein each opposing rectilinear side wall of said second pair of opposing rectilinear side walls respectively has a second height extending from respective said moveable housing bottom edges to respective said moveable housing top edges, said second height being equal to said first height;

wherein each opposing rectilinear side wall of said first pair of opposing rectilinear side walls respectively includes a first pivot location disposed proximate to respective said base housing top edges and proximate to respective said rearward edges, said first pivot locations respectively having a first pivot height positioned a first pivot height distance above respective said base housing bottom edges;

wherein each opposing rectilinear side wall of said second pair of opposing rectilinear side walls respectively includes a second pivot location disposed closer to respective said moveable housing top edges than respective said moveable housing bottom edges, the second pivot locations are respectively positioned between respective said back and forward edges, said second pivot locations respectively positioned a second pivot height distance above respective said moveable housing bottom edges, said second pivot height distance being equal to said first pivot height distance, said second pivot locations respectively positioned a lateral displacement distance from respective said forward edges, wherein said lateral displacement distance is generally equal to the second pivot height distance;

wherein said base housing is molded of plastic and said moveable housing is molded of plastic;

a first pivot coupler having a first spring loaded locking mechanism passing through a first one of the first pivot locations and a respective first one of the second pivot locations;

a second pivot coupler having a second spring loaded locking mechanism passing through a second one of the first pivot locations and a respective second one of the second pivot locations, said first and second pivot couplers respectively configured to lock the stool in the single step mode and the double step mode; and wherein said first planar top surface forms a first plane, said second planar top surface forms a second plane, and said back wall forms a third plane, wherein said moveable housing is configured to rotate about said first and second pivot couplers to move said stool between said single step and double step modes, wherein the stool is positioned in the single step mode when said first plane is coplanar with said second plane to form a continuous planar surface while all of the bottom edges are aligned to rest on flat ground, wherein the stool is positioned in the double step mode when said first plane is generally perpendicular to said second plane while said first plane is generally parallel with said third plane while said forward edges are aligned with said base housing bottom edges to rest on flat ground, wherein the stool is configured to allow a user to walk directly on the first planar top surface, the second planar top surface and the back wall during use.

2. The convertible step stool of claim 1, wherein said first planar top surface includes a front edge coupled to said front wall and said first planar top surface includes a rearward edge positioned opposite of said front edge of said first planar top surface, said rearward edge of said first planar top surface including an intermediate flange extension positioned generally midway between said first pair of opposing rectilinear side walls, said flange extension having a flange width and a flange length, and wherein said second planar top surface includes a back edge coupled to said back wall, and said second planar top surface includes a forward edge positioned opposite of said back edge of said second planar top surface, said forward edge of said second planar top surface including an intermediate flange cavity receiving said flange extension.

3. The convertible step stool of claim 2 further comprising:

a pair of non-skid feet capable of coupling to the bottom edges of said base housing;

a pair of non-skid feet capable of coupling to the bottom edges of said moveable housing; and a pair of non-skid feet capable of coupling to the forward edges of said moveable housing.

4. The convertible step stool of claim 1, wherein said first and second pivot couplers are configured to lock to resist movement between said single step and double step modes.

5. The convertible step stool of claim 4 further comprising:

a pair of non-skid feet capable of coupling to the bottom edges of said base housing;

a pair of non-skid feet capable of coupling to the bottom edges of said moveable housing; and a pair of non-skid feet capable of coupling to the forward edges of said moveable housing.

6. The convertible step stool of claim 1 further comprising:

a pair of non-skid feet capable of coupling to the bottom edges of said base housing;

a pair of non-skid feet capable of coupling to the bottom edges of said moveable housing; and a pair of non-skid feet capable of coupling to the forward edges of said moveable housing.

7. A convertible step stool moveable between a single step mode and a double step mode, said convertible step stool comprising:

a base housing having a first planar top surface coupled to a first plurality of walls, said first plurality of walls including a rectilinear front wall and a first pair of opposing rectilinear side walls, each opposing rectilinear side wall of said first pair of opposing rectilinear side walls respectively having a base housing bottom edge, a rearward edge, a base housing top edge coupled to said first planar top surface, and a front edge, wherein said front wall is coupled to said first planar top surface and extends between said front edges;

a moveable housing, rotatably coupled to said base housing, having a second planar top surface coupled to a second plurality of walls, said second plurality of walls including a rectilinear back wall and a second pair of opposing rectilinear side walls, each opposing rectilinear side wall of said second pair of rectilinear side walls respectively having a moveable housing bottom edge, a forward edge, a moveable housing top edge coupled to said second planar top surface, and a back edge, wherein said back wall is coupled to said second planar top surface and extends between said back edges;

wherein said front wall has a first major length extending between said front edges;

wherein said back wall has a second major length extending between said back edges, said second major length being less than said first major length;

wherein each opposing rectilinear side wall of said first pair of opposing rectilinear side walls respectively has a first height extending from respective said base housing bottom edges to respective said base housing top edges;

wherein each opposing rectilinear side wall of said second pair of opposing rectilinear side walls respectively has a second height extending from respective said moveable housing bottom edges to respective said moveable housing top edges, said second height being equal to said first height;

wherein each opposing rectilinear side wall of said first pair of opposing rectilinear side walls respectively includes a first pivot location disposed proximate to respective said base housing top edges and proximate to respective said rearward edges, said first pivot locations respectively having a first pivot height positioned a first pivot height distance above respective said base housing bottom edges;

wherein each opposing rectilinear side wall of said second pair of opposing rectilinear side walls respectively includes a second pivot location disposed closer to respective said moveable housing top edges than respective said moveable housing bottom edges, the second pivot locations being respectively positioned between respective said back and forward edges, said second pivot locations respectively positioned a second pivot height distance above respective said moveable housing bottom edges, said second pivot height distance being equal to said first pivot height distance, said second pivot locations respectively positioned a lateral displacement distance from respective said forward edges, wherein said lateral displacement distance is generally equal to the second pivot height distance;

a first pivot coupler attaching a first one of the first pivot locations to a respective first one of the second pivot locations;

a second pivot coupler attaching a second one of the first pivot locations to a respective second one of the second pivot locations;

wherein said first planar top surface includes a front edge coupled to said front wall and said first planar top surface includes a rearward edge positioned opposite of said front edge of said first planar top surface, said rearward edge of said first planar top surface including a flange extension positioned generally midway between said first pair of opposing rectilinear side walls, said flange extension having a flange width and a flange length, and wherein said second planar top surface includes a back edge coupled to said back wall, and said second planar top surface includes a forward edge positioned opposite of said back edge of said second planar top surface, said forward edge of said second planar top surface including an intermediate flange cavity receiving said flange extension;

wherein said flange cavity includes a pair of projections coaxial with a pivot axis formed by said first and second pivot couplers, said flange cavity further comprising:

a first projection of said pair of projections coupling said cavity to a first outside vertical surface of said flange extension, and a second projection coupling said cavity to a second outside vertical surface of said flange extension; and wherein said first planar top surface forms a first plane, said second planar top surface forms a second plane, and said back wall forms a third plane, wherein said moveable housing is configured to rotate about said first and second pivot couplers to move said stool between said single step and double step modes, wherein the stool is positioned in the single step mode when said first plane is coplanar with said second plane to form a continuous planar surface while all of the bottom edges are aligned to rest on flat ground, wherein the stool is positioned in the double step mode when said first plane is generally perpendicular to said second plane while said first plane is generally parallel with said third plane while said forward edges are aligned with said base housing bottom edges to rest on flat ground, wherein the stool is configured to allow a user to walk directly on the first planar top surface, the second planar top surface and the back wall during use.

8. The convertible step stool of claim 7, wherein said first and second pivot couplers are configured to lock to resist movement between said single step and double step modes.

9. The convertible step stool of claim 8 further comprising:

a pair of non-skid feet capable of coupling to the bottom edges of said base housing;

a pair of non-skid feet capable of coupling to the bottom edges of said moveable housing; and a pair of non-skid feet capable of coupling to the forward edges of said moveable housing.

10. The convertible step stool of claim 7 further comprising:

a pair of non-skid feet capable of coupling to the bottom edges of said base housing;

a pair of non-skid feet capable of coupling to the bottom edges of said moveable housing; and a pair of non-skid feet capable of coupling to the forward edges of said moveable housing.

* * * * *